US006276645B1

(12) United States Patent
Chang

(10) Patent No.: US 6,276,645 B1
(45) Date of Patent: Aug. 21, 2001

(54) ADJUSTABLE GARBAGE BAG HOLDER

(76) Inventor: William Nai-Jen Chang, 20 Glen Echo Ct., Brampton (CA), L6S 5T9

( * ) Notice: Subject to any disclaimer, the term of this patent is extended or adjusted under 35 U.S.C. 154(b) by 0 days.

(21) Appl. No.: 09/531,298

(22) Filed: Mar. 20, 2000

(51) Int. Cl.[7] ..... B65B 67/12

(52) U.S. Cl. ..... 248/99; 248/95; 248/97; 248/101

(58) Field of Search ..... 248/99, 97, 101, 248/95

(56) References Cited

U.S. PATENT DOCUMENTS 1,542,164 * 6/1925 Nelson .
3,135,984 * 6/1964 Henke ..... 15/257.1
3,796,402 * 3/1974 Trotta ..... 248/97
4,174,085 * 11/1979 Ferreira et al. ..... 248/97
4,759,519 * 7/1988 Cheng ..... 248/99
4,832,292 * 5/1989 Beckham ..... 248/99
5,050,902 * 9/1991 Potticary ..... 294/55

* cited by examiner

*Primary Examiner*—Leslie A. Braun
*Assistant Examiner*—S M Marsh

(57) ABSTRACT

This portable device is for holding and supporting a flexible waste collection bag in an open condition. The device has a frame consisting of two parallel side bars having a handle at one end and the free ends of the side bars are mounted to a lower supporting platform bar. A slider bar is slidably mounted on the side bars and located between the handle and the lower supporting platform bar. Both the slider bar and the supporting platform bar have a horizontal U-shaped channel. A flexible waste collection bag can be mounted to the device by wrapping two opposite sides of the lip portion of the bag on two securement bars and inserting the wrapped securement bars into the U-shaped channels in the slider bar and the supporting platform bar to secure the bag to the device. The slider is pushed upwards to maintain the bag in an open condition. Bags of a variety of different sizes may be mounted to the device by adjusting the position of the slider bar.

8 Claims, 12 Drawing Sheets

ADJUSTABLE GARBAGE BAG HOLDER

BACKGROUND OF THE INVENTION

This invention relates to a portable device for holding and supporting a flexible waste collection bag in an open condition; and more particularly, it relates to a portable device adjustable for holding a flexible waste collection bag in a variety of different sizes.

Flexible waste collection bags are convenient to use; however, it is often difficult to maintain them in an open condition during use for their filling operation. There are known devices which have a base on which a flexible bag may be mounted in a fixed location in an open condition to facilitate its filling. Such devices are complex in construction, and are not portable. Furthermore, such devices are designed for holding a flexible waste bag of a single size only. Since the size of conventional flexible waste collection bags is not standardized, the usage of such devices is problematic as it depends on the availability of the flexible waste collection bag of a specific size for which each of these devices is designed.

SUMMARY OF THE INVENTION

It is a principal object of the present invention to provide a portable device which is operative to hold and support a flexible waste collection bag in an open condition.

It is another object of the present invention to provide a flexible waste collection bag mounting device which is adjustable to accommodate a flexible waste collection in a variety of different sizes.

It is another object of the present invention to provide a flexible waste collection bag mounting device including a sloping platform to facilitate sweeping of waste matters on the ground into the bag.

It is yet another object of the present invention to provide a flexible waste collection bag mounting device which has few component parts and is simple to operate.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
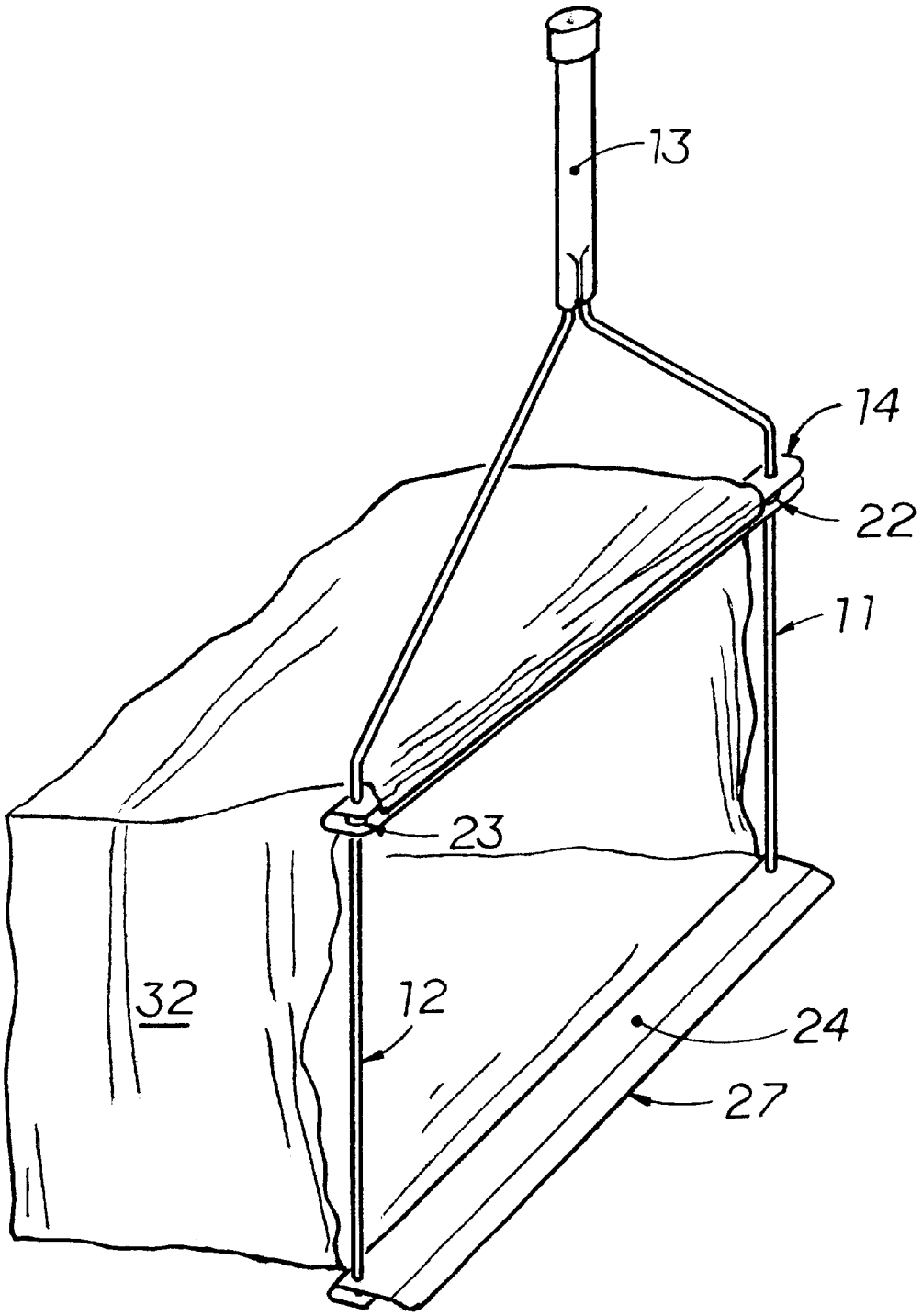
FIG. 1 is a perspective elevation view of the flexible waste collection bag holding device according to the present invention with a flexible bag mounted thereon.
Figure 2:
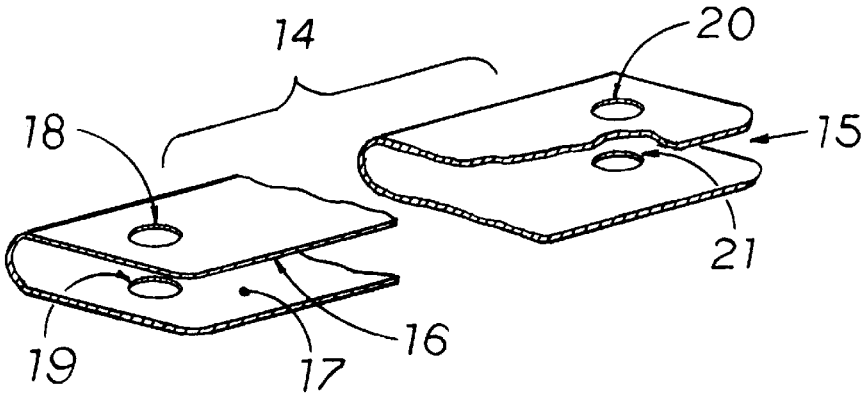
FIG. 2 is an isolated perspective elevation view of the upper slider bar in the holding device according to the present invention.
Figure 7:
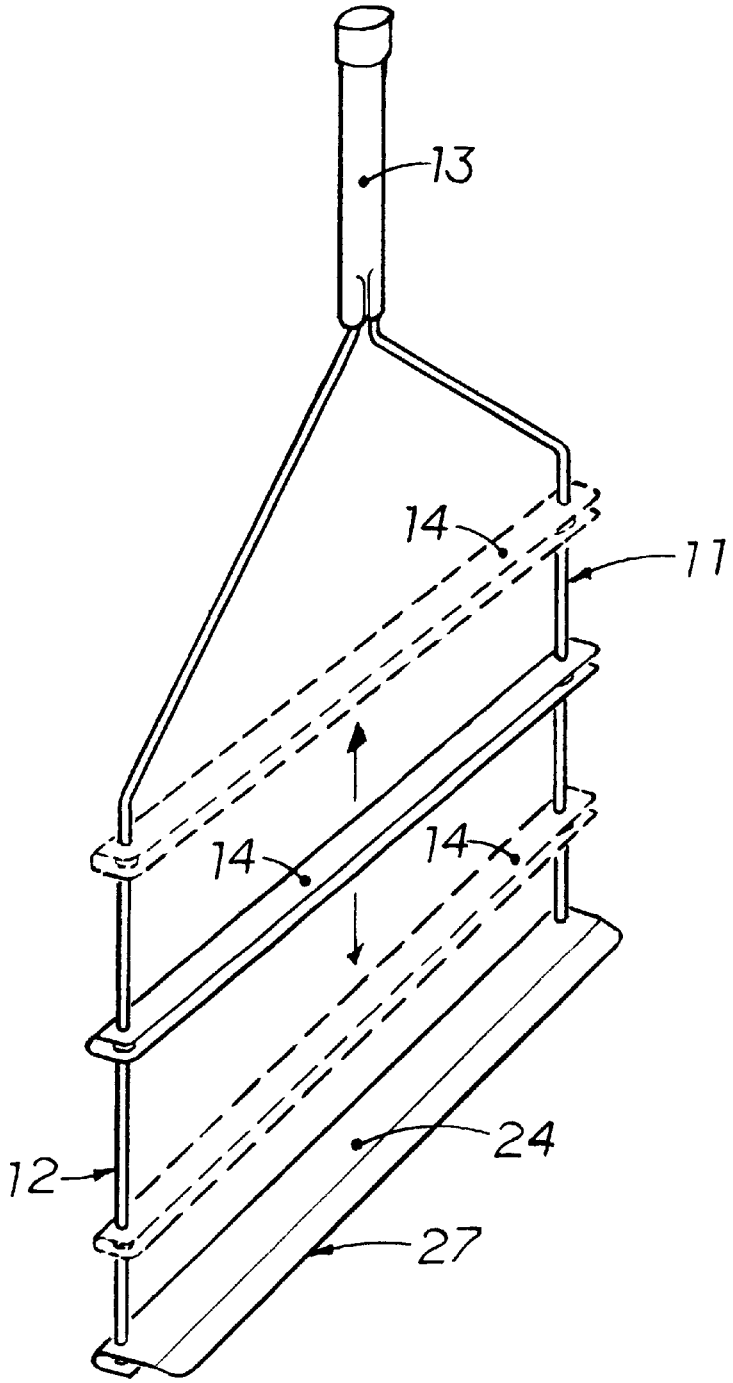
FIG. 7 is a perspective side elevation view of the holding device according to the present invention showing the adjustability of the position of the upper slider bar.
Figure 8:
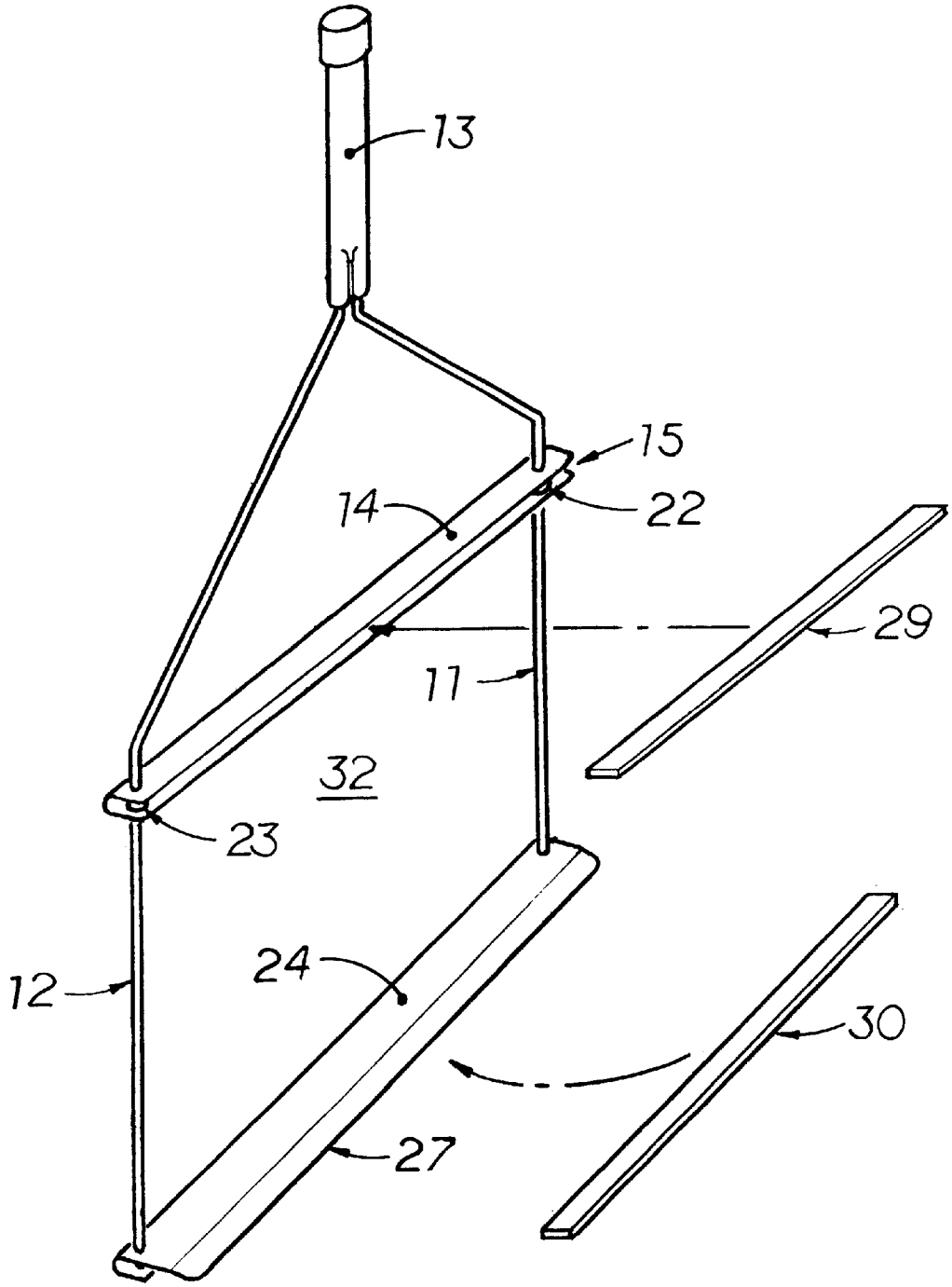
FIG. 8. is a perspective exploded side elevation view of the holding device and the securement bars.

Referring now to the drawings in which like reference numerals designate corresponding parts in the several views, the holding device 10 of the present invention has two side bars 11 and 12 extending parallel to one another. The upper portion of these side bars 11 and 12 are bent towards one another and are mounted to a handle 13. An upper slider bar 14 having a horizontal U-shaped cross section is slidably mounted to the side bars 11 and 12. As best shown in FIG. 2, the upper slider bar 14 has a U-shaped channel 15 therein facing forwards. The U-shaped channel 15 has an upper side wall 16 and a lower side wall 17. An opening 18 is formed adjacent to the left end of the upper side wall 16 and a corresponding opening 19 is formed adjacent to the left end of the lower side wall 17. The openings 18 and 19 are aligned with one another. Similarly, an opening 20 is formed adjacent the right end of the upper side wall and another opening 21 is formed adjacent the right end of the lower side wall of the upper slider bar 14. The openings 20 and 21 are aligned with one another. The upper slider bar 14 is slidably mounted to the side bars 11 and 12 with the side bar 12 extending through the openings 18 and 19 and the side bar 11 extending through the openings 20 and 21. A friction slider 22 and a similar friction slider 23 are located in the U-shaped channel 15 and are respectively slidably mounted to the side bars 11 and 12. The friction sliders 22 and 23 are made of rubber or a plastic material and they are provided with a through opening so that they may be firmly fitted on the side bars 11 and 12. The friction sliders 22 and 23 normally maintain the upper slider bar 14 securely at a selected position along the length of the side bars 11 and 12. As shown in FIG. 7, the upper slider bar 14 may be slidably moved up or down the side bars 11 and 12 to any selected position by pushing the upper slider bar 14 against the frictional holding force between the upper slider bar 14 and the friction sliders 22 and 23.

Figure 3:
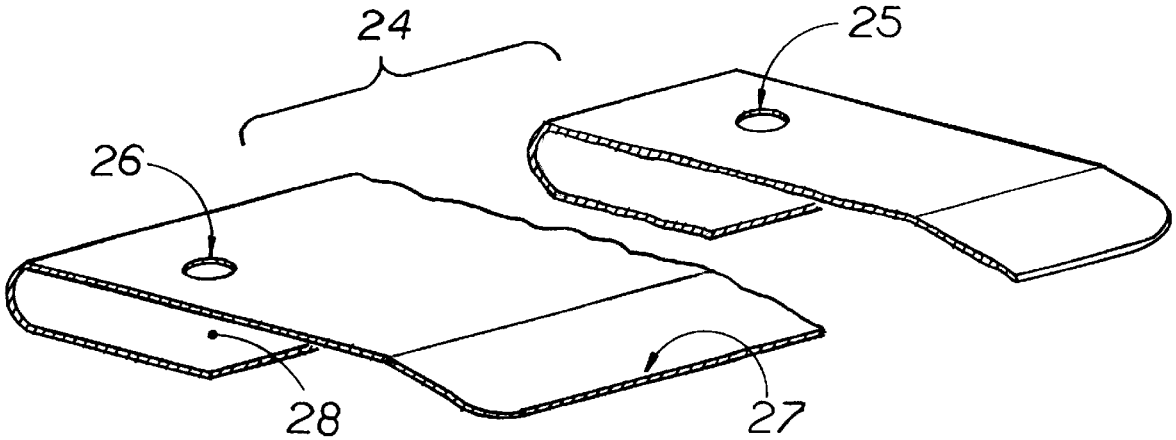
FIG. 3 is an isolated perspective elevation view of the lower supporting platform in the holding device.
Figure 4:
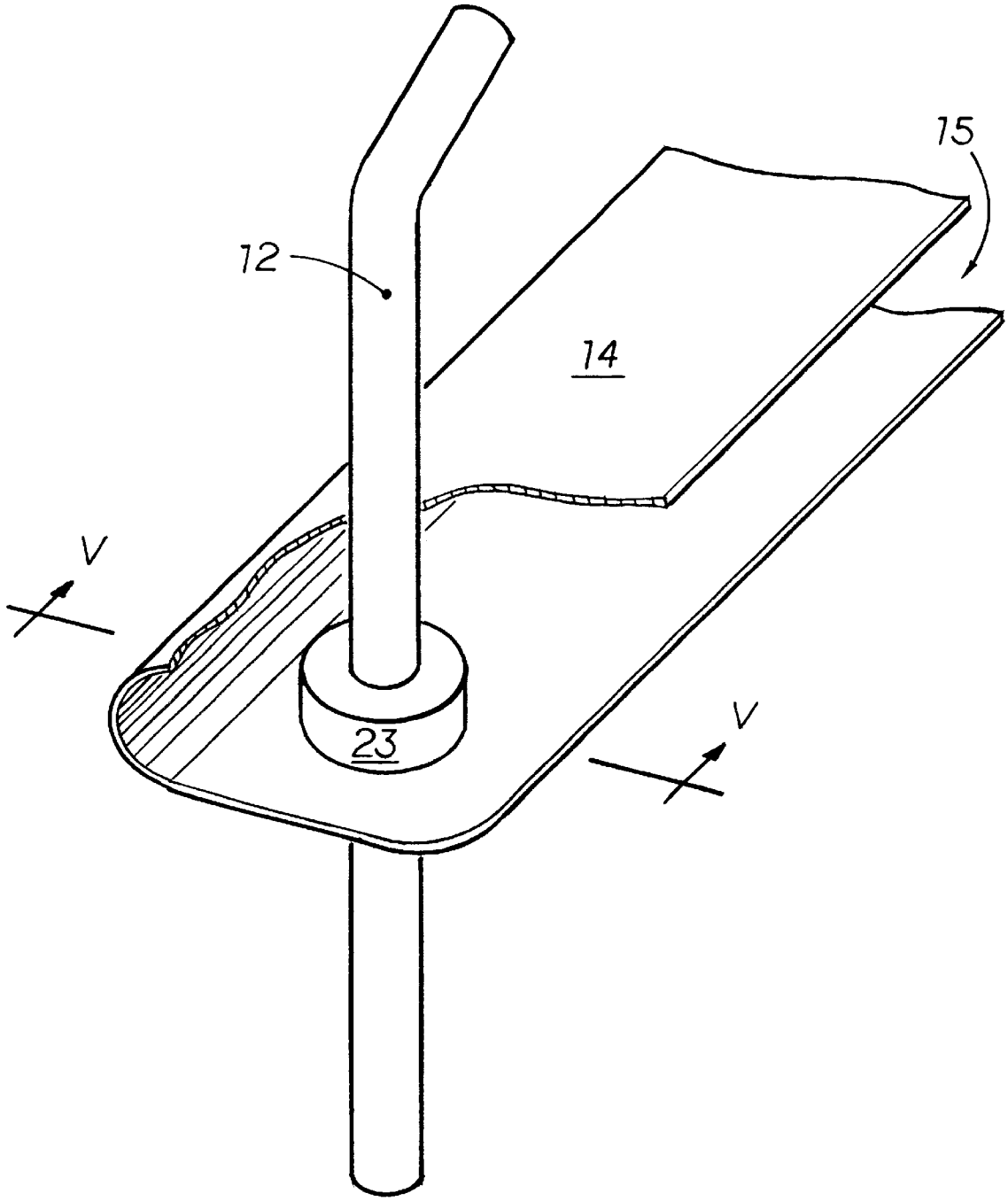
FIG. 4 an isolated partial elevation cut view of the upper slider bar and a friction slider slidably mounted to the side bar of the holding device.
Figure 5:
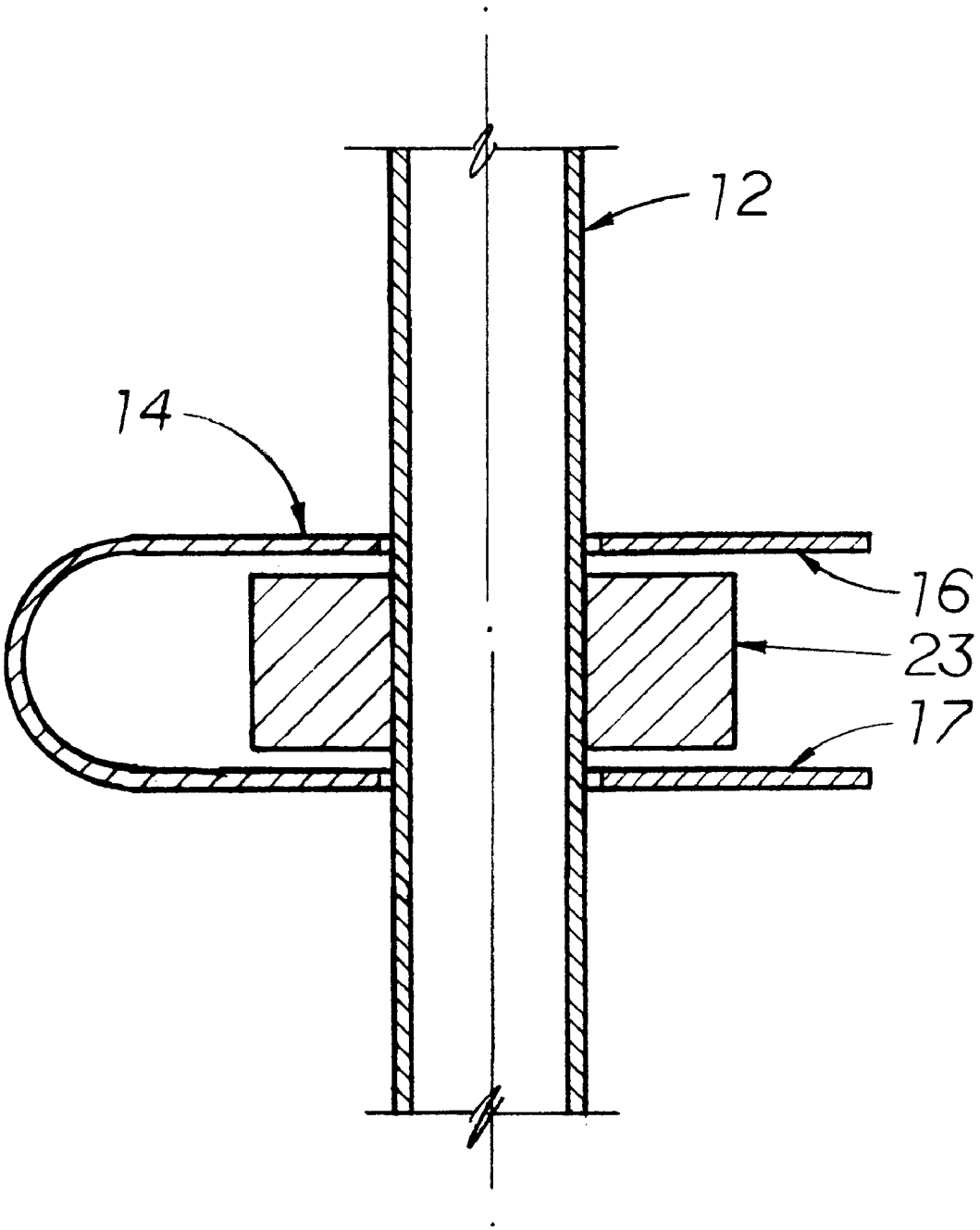
FIG. 5 is an isolated sectional side view along section line V—V of FIG. 4.
Figure 6:
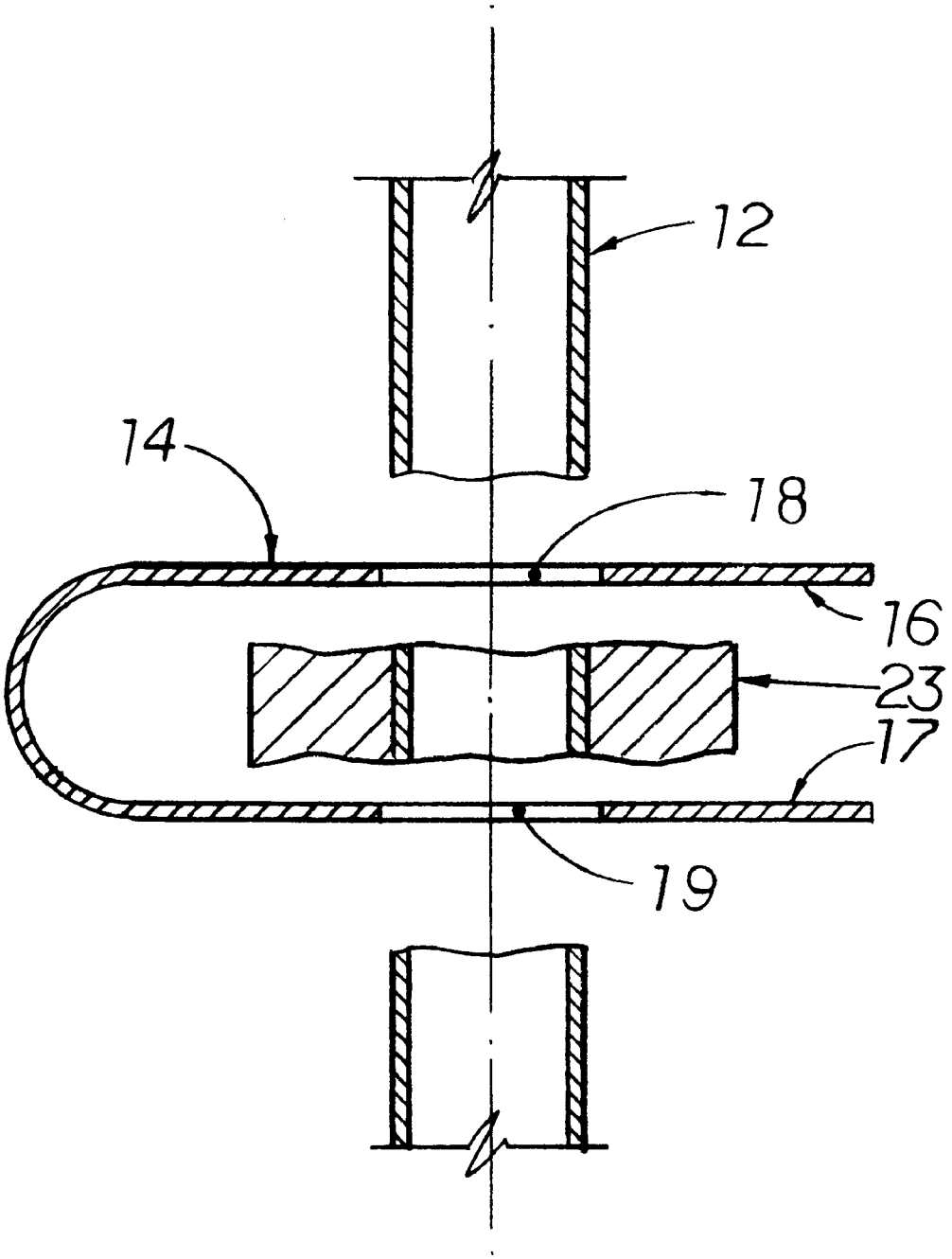
FIG. 6 is an isolated exploded sectional side view of FIG. 5 showing the relative dimensions of the upper slider bar, the slider and the side bar.

The lower end of the side bars 11 and 12 are fixedly mounted to a lower support platform bar 24. As shown in FIG. 3, two mounting openings 25 and 26 may be provided adjacent the right and left ends of the lower support platform bar 24 so that the ends of the side bars 11 and 12 may be inserted into these openings 25 and 26 prior to securing the side bars 11 and 12 to the lower support platform bar 24 by threaded nuts, soldering, or welding. The lower support platform bar 24 maintains the holding device 10 in a stable and sturdy manner. The lower support platform bar 24 has an extended front edge portion 27 extending forwardly and downwardly, and a horizontal U-shaped channel 28 is formed at the underside therein. The U-shaped channel 28 also faces forwards. The extended front edge portion 27 provides a guide which will abut the ground when the device is placed on the ground so as to facilitate sweep of waste matters on the ground into the flexible waste collection bag mounted on the holding device.

Two elongated securement bars 29 and 30 are provided. These securement bars 29 and 30 have a length shorter than the distance between the side walls of the friction sliders 22 and 23 and they have a shape and dimension such that they may be slidably inserted sideways into the U-shaped channel 15 of the upper slider bar 14 and the U-shaped channel 28 at the underside of the lower support platform bar 24 respectively and be retained therein by frictional fit.

Figure 9:
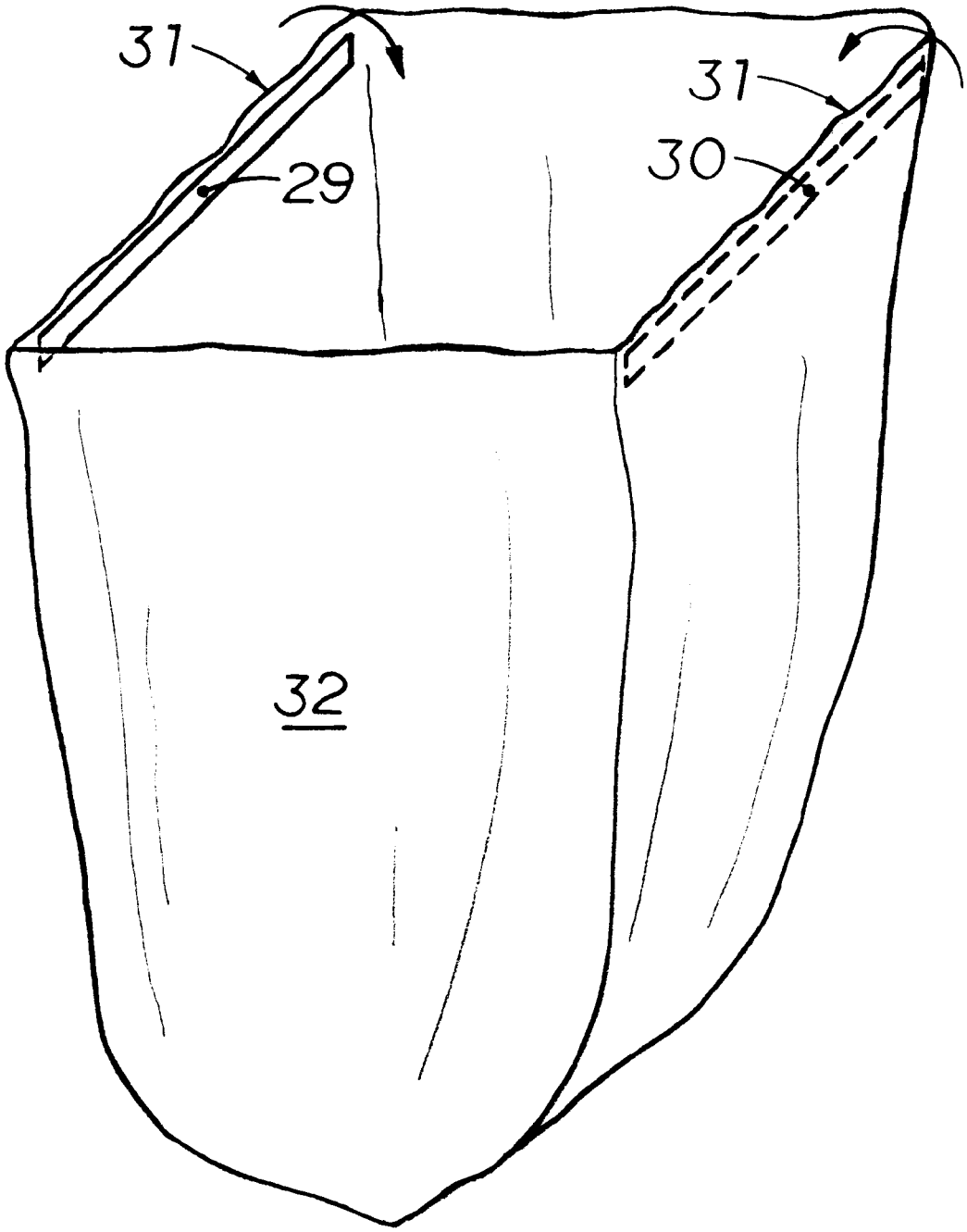
FIG. 9 is a perspective side elevation view of a flexible waste collection bag with the securement bars positioned at opposite side of its mouth in the mounting operation.
Figure 10:
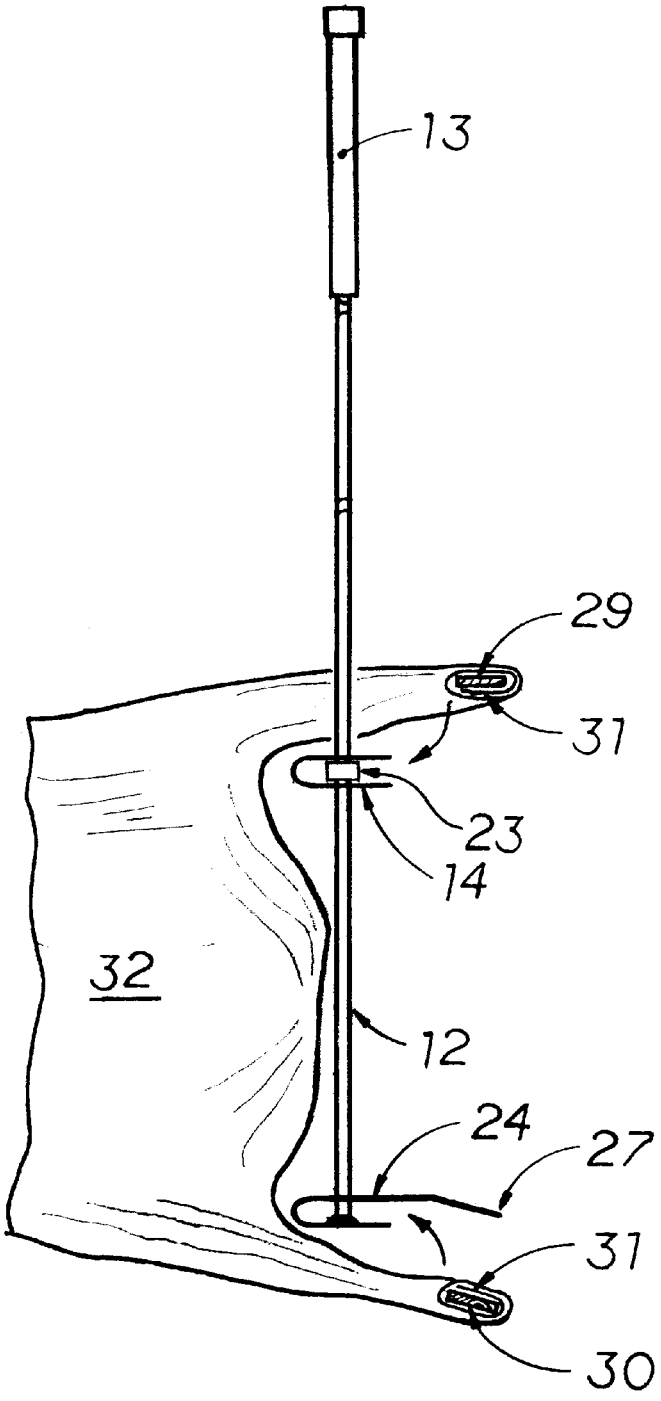
FIG. 10 is a perspective side elevation view of the holding device with the flexible waste collection bag located in the position for mounting and the mouth portion of the bag wrapped over the securement bars.
Figure 11:
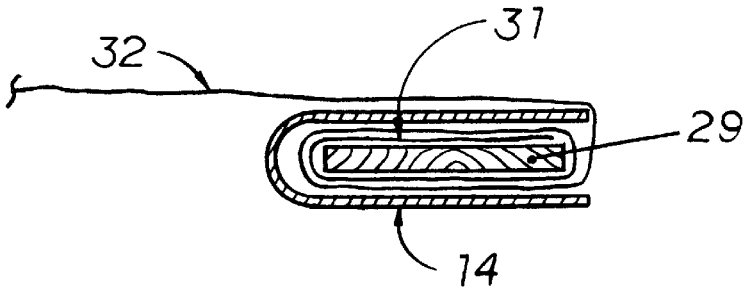
FIG. 11 is an isolated sectional side view of the upper slider bar showing the upper edge portion of the flexible waste collection bag wrapped over the securement bar and then secured within the U-shaped channel in the upper slider bar.
Figure 12:
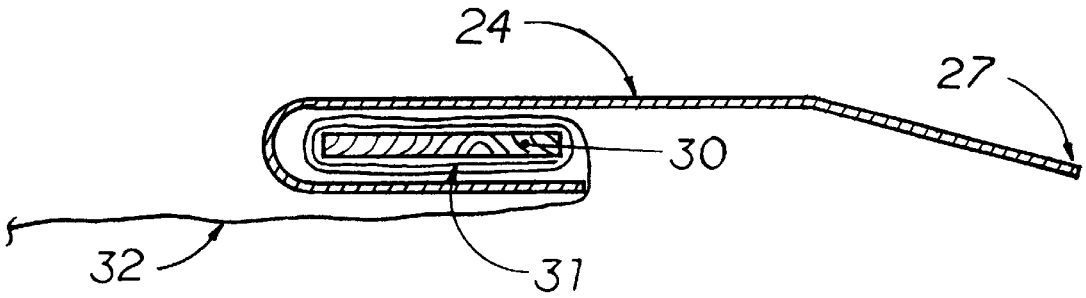
FIG. 12 is an isolated sectional side view of the lower support platform showing the lower edge portion of the flexible waste collection bag wrapped over the securement bar and then secured within the U-shaped channel in the lower support platform.

In operation, the securement bars 29 and 30 are positioned on two opposite sides of the lip portion 31 of a flexible waste collection bag 32 as best shown in FIG. 9. The lip portion 31 of the bag is then folded to wrap over the securement bars 29 and 30, and the bag is located adjacent to the holding device 10 as shown in FIG. 10. The upper slider bar 14 is moved along the side bars 11 and 12 to the lowest position. The securement bars 29 and 30 with the lip portion 31 of the bag wrapped thereon are then slidably inserted into the U-shaped channels 15 and 28 respectively such that they are retained in place securely by frictional fit. The upper slider bars 14 is then moved upwards until the mouth of the flexible waste collection bag 32 is stretched out tautly in an open condition so that waste matters may be conveniently filled into the now opened bag. The flexible waste collection bag 32, thus maintained in the open condition may be carried around with the handle 13. The holding device 10 with the bag 32 mounted thereon may be placed on the ground with the downwardly sloping extended edge portion 27 of the lower support platform 24 abutting the ground such that waste matters may be easily swept from the ground into the opened bag. During use, the upper slider bar 14 may be moved downwards to close the mouth of the flexible waste collection bag 32 to avoid the waste matters from falling out of the bag when the user is moving about carrying the holding device with the flexible bag mounted thereon.

Figure 13:
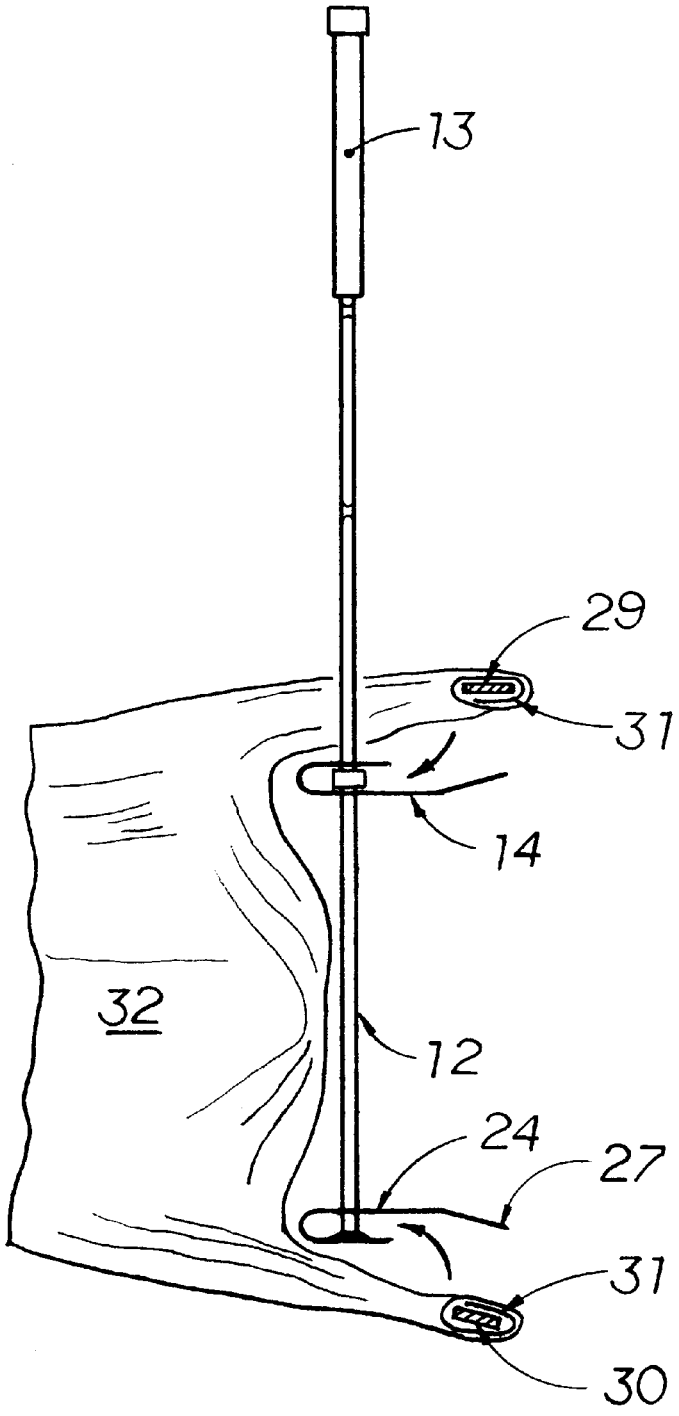
FIG. 13 is a perspective side elevation view showing an alternative embodiment of the holding device in which the upper slider bar and the lower support platform are identical in construction.

The upper slider bar 14 may have the same shape as the lower supporting platform 24 as shown in FIG. 13 to serve the same purpose so as to simplify the manufacturing of the component parts of the holding device. In this embodiment, a lower supporting platform bar is turned upside down to serve as the upper slider bar.

Figure 14:
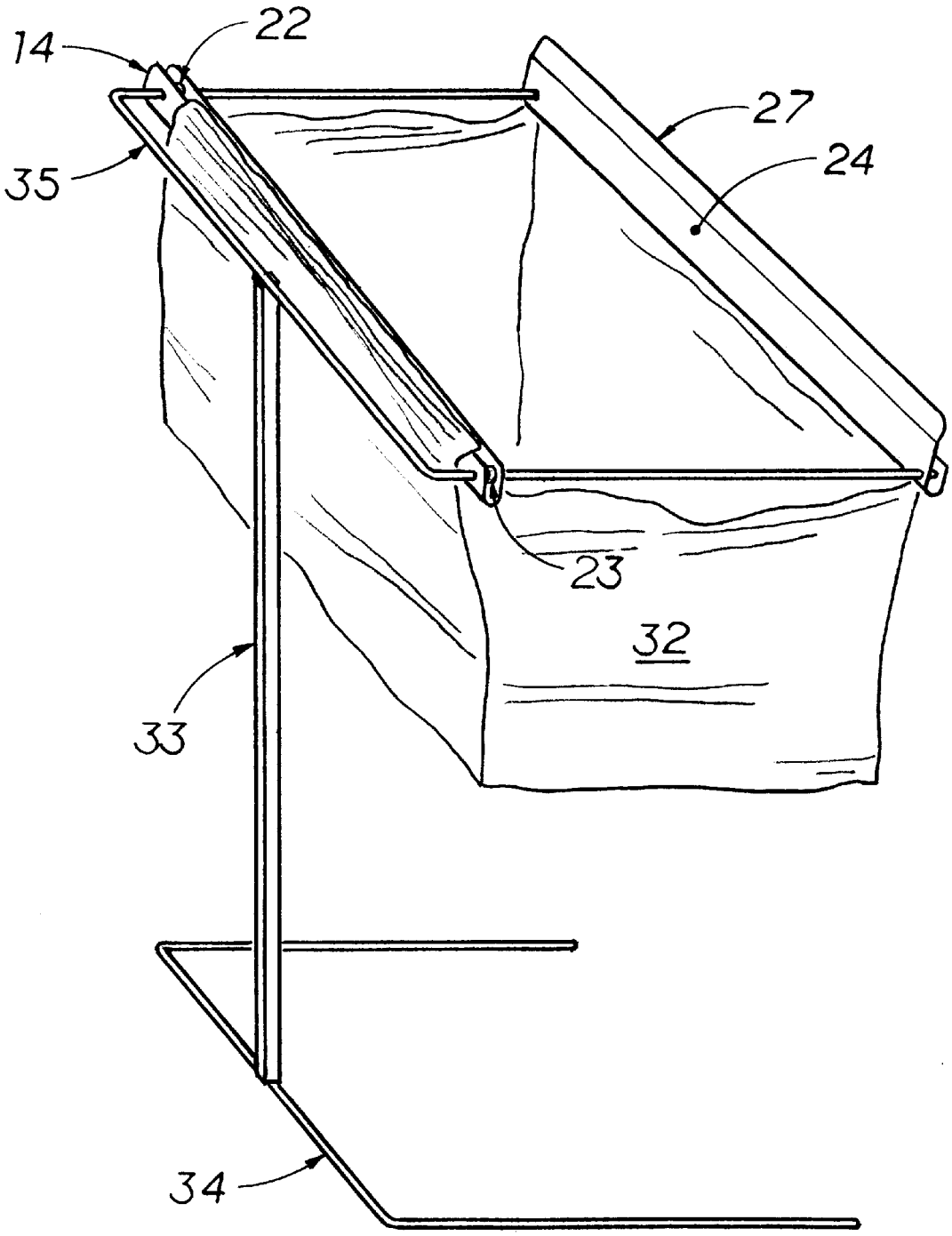
FIG. 14 is a perspective elevation view of the holding device of the present invention provided with a stand for resting it on the ground.

A stand 33 with a U-Shaped base 34 may be provided to support the device 10 such that the flexible waste collection bag 32 may be maintained in an open condition in the horizontal position as shown in FIG. 14 for the waste filling operation. To simplify the manufacturing process, the side bars 11 and 12 may be formed by bending a single bar into a U-shaped having two side arms forming the side bars 11 and 12 and a cross bar 35. The stand 33 may then be mounted to the center point of the cross bar 35 to support the device 10 in cantilever manner as shown in FIG. 14. It can be appreciated by those skilled in the art that the device 10 shaped as shown in the first embodiment may be removably mounted to the handle 13 and a cantilever sleeve similar to the handle may be provided at the top end of the stand 33 such that the device 10 may be removably mounted to the cantilever sleeve.

While the preferred embodiments of the invention have been described above. It will be recognized and understood that various modifications may be made therein without departing from the spirit or essential attributes thereof, and it is desired therefore that only such limitations be placed thereon as are imposed by the appended claims.

What I claim is:

1. A holding device for maintaining a flexible waste collection bag in an open condition, comprising:

a rigid frame including two side bars located mutually parallel to each other, said side bars having a top portion bended towards each other and mounted to a handle, a slider bar slidably mounted on said side bars and extending between said side bars, said slider bar having a horizontal U-shaped channel extending in a forward direction, a lower support platform bar fixedly mounted to lower free ends of said side bars and extending between said side bars, said lower supporting platform having a horizontal underside U-shaped channel formed at an underside therein, and said underside U-shaped channel also facing said forward direction, friction sliders mounted on said side bars and located within said U-shaped channel of said slider bar, a first elongated securement bar having a shape and size adapted to engage within said U-shaped channel of said slider bar, a second elongated securement bar having a shape and size adapted to engage within said underside U-shaped channel of said lower support platform bar, wherein said securement bars are adapted to have lip portions of the bag wrapped therearound, and said securement bars are adapted to be inserted into said slider bar and said lower support platform bar, to secure the bag thereto.

2. A holding device according to claim 1 wherein said lower support platform bar includes an extended front edge portion extending forwardly and downwardly.

3. A holding device according to claim 2 wherein said slider bar is same as said lower supporting platform bar positioned upside down.

4. A holding device according to claim 2 including a stand adapted to receive said device to be mounted thereto in a cantilever fashion.

5. A holding device according to claim 3 wherein said friction sliders are made of a rubber material.

6. A holding device according to claim 3 wherein said friction sliders are made of a plastic material.

7. A holding device according to claim 3 wherein said top portion of said side bars are joined with each other to form a cross bar.

8. A holding device according to claim 7 including a stand secured to a mid point of said cross bar to support said device in a cantilever fashion.

* * * * *